United States Patent [19]

Friedman

[11] 4,215,291

[45] Jul. 29, 1980

[54] COLLECTIVE PARTICLE ACCELERATOR

[75] Inventor: Moshe Friedman, Washington, D.C.

[73] Assignee: The United States of America as represented by the Secretary of the Navy, Washington, D.C.

[21] Appl. No.: 8,820

[22] Filed: Feb. 2, 1979

[51] Int. Cl.[2] ..... H01J 25/10

[52] U.S. Cl. ..... 315/5.41; 315/5.42; 315/4; 328/233

[58] Field of Search ..... 315/5.41, 5.42, 3, 4, 315/5, 39.3; 328/233

[56] References Cited

U.S. PATENT DOCUMENTS

| | | | |
|---|---|---|---|
| 3,072,817 | 1/1963 | Gordon | 315/3 |
| 3,259,786 | 7/1966 | Phillips | 315/5.41 X |
| 3,489,943 | 1/1970 | Denholm | 315/5.41 X |
| 3,789,257 | 1/1974 | Friedman et al. | 315/3 |
| 3,887,832 | 6/1975 | Drummond et al. | 315/5.41 |
| 3,892,970 | 7/1975 | Freeman et al. | 250/396 |
| 3,916,239 | 10/1975 | Friedlander | 315/39.3 |
| 4,038,602 | 7/1977 | Friedman | 328/233 |
| 4,070,595 | 1/1978 | Miller | 328/233 |
| 4,143,299 | 3/1979 | Sprangle et al. | 315/5.41 |

*Primary Examiner*—Saxfield Chatmon, Jr.
*Attorney, Agent, or Firm*—R. S. Sciascia; Philip Schneider; Melvin L. Crane

[57] ABSTRACT

A collective particle accelerator including an intense relativistic electron beam (IREB) generator, an automodulation section, an acceleration region and injection region. A negative high voltage is applied to a ring cathode which produces an IREB. The IREB propagates through the accelerator. On propagating through the automodulation section, the electrons are modulated thereby forming them into ring-shaped bunches. The acceleration section is surrounded by a longitudinal uniform magnetic field along its length and is provided with special magnetic field means which changes the uniform magnetic field to a rippled magnetic field. The rippled magnetic field causes the bunches of electrons to contract and expand radially as they propagate through the rippled magnetic field which in turn causes ions or electrons injected into the system to be accelerated by attraction or repulsion as the electron rings contract and expand radially.

10 Claims, 4 Drawing Figures

COLLECTIVE PARTICLE ACCELERATOR

BACKGROUND OF THE INVENTION

This invention relates to particle accelerators and more particularly to an electron or ion accelerator making use of an IREB.

Various systems have been suggested for accelerating electrons and ions by an intense relativistic electron beam. It has been suggested in the prior art that waves "riding" on an IREB can, under certain conditions, accelerate ions. These waves can take the form of cyclotron waves (U.S. Pat. No. 3,887,832), or a large-amplitude electrostatic "well" associated with the front of an IREB. By manipulating beam parameters (e.g., current, magnetic field, geometry, etc.) the phase velocity of these waves can be controlled. When the phase velocity is small enough ions can be trapped by the wave. By "accelerating" the wave (i.e., increasing its phase velocity) the trapped ions will be dragged along and gain energy from the wave. If during the acceleration process an ion escapes from the wave the acceleration phase will end and the ion will be lost. The generation of these waves and the control of their phase velocity may require beam parameters which are not attainable (e.g., monochromatism of particle energy).

SUMMARY OF THE INVENTION

A high voltage source is used to produce an annular IREB which is propagated through an automodulation section that changes the electron beam into equally spaced rings of electrons. The rings of electrons move through a rippled magnetic field which causes the rings of electrons to contract and expand radially as the rings pass through the rippled magnetic field. As the rings of electrons contract they will attract ions (or repel electrons).

Acceleration of ions or electrons will be achieved when the radial motions of successive rings are such that ions (or electrons) will reach any ring so as to be attracted (or repelled). The conditions for acceleration of ions (or electrons) depend on the frequency of the bunched IREB and the wavelength of the rippled magnetic field. This device accelerates ions and electrons without the problems of prior art accelerators.

DETAILED DESCRIPTION

Figure 1:
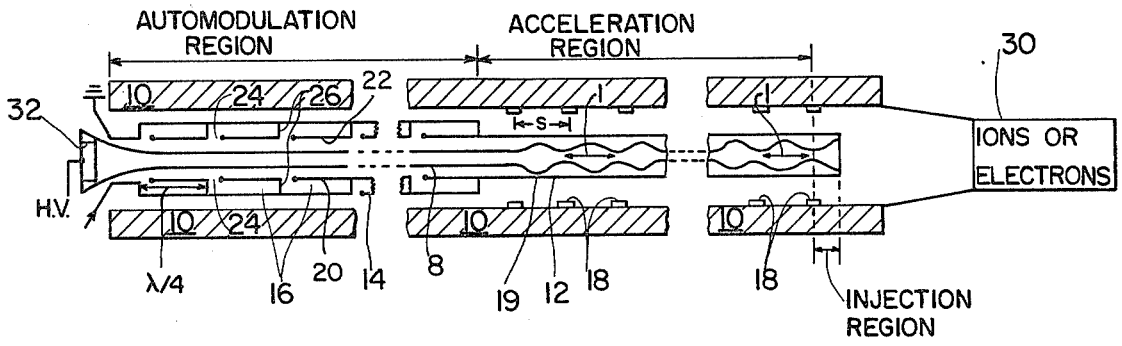
FIG. 1 is a schematic drawing of the accelerator.

As shown in FIG. 1, the accelerator includes an IREB-producing means, an automodulation region, an acceleration region and an injection region. A static, uniform, homogeneous, longitudinal magnetic field 8 is produced by a plurality of side-by-side coils 10 positioned along the length of the accelerator. An acceleration drift tube of stainless steel is supported coaxially within the magnetic field coils and is of the same length as the overall length along which the magnetic coils are placed. The acceleration drift tube comprises two sections 12 and 14 each of which have the same inner diameter with the section 14 along the automodulation region being modified to include several quarter-wave coaxial cavities 16 which will be described latter.

The acceleration region and injection region are provided with small equally spaced magnetic field coils 18 placed within the area confined by the coils 10 and axially spaced from each other to form a rippled magnetic field 19. The axial spacing of the small coils, s, is different for acceleration of ions and electrons and the coils can be accordingly moved to different positions. The spacing depends upon the velocity of the beam of accelerated particles. The combination of the homogeneous magnetic field and the magnetic field produced by the small coils from a "rippled" magnetic field (i.e., alternating sections of greater and lesser field strength). The "rippled" magnetic field produces the radial motion of the electron bunches.

Section 14 of the acceleration drift tube extends along the length of the automodulation region and has the same inner diameter as tube section 12. The tube section 14 has an outer wall 20 and an inner wall 22 with a spacing between the inner and outer wall. The inner wall has cylindrical, radial openings 24 therein which communicate with the spacing between the walls with the spacing having spaced walls 26 perpendicular to the inner and outer walls placed adjacent to the openings 24. The spacing of perpendicular walls 26 are such that they form one-quarter wave ($\lambda/4$) coaxial cavities along the length of the automodulation region. As an example, the coaxial cavities may have an inner diameter of 4.7 cm and an outer diameter of 18 cm with the length of each cavity 15 cm. This cavity will oscillate with a frequency of 555 MHz. The frequency will change with size of the cavities. An ion or electron particle generator 30 is used for injecting the particles to be accelerated into the drift tube 12 from the end opposite from the automodulation end. Ions could be injected from the automodulation end of the accelerator, if desired, and accelerated by the same principle. Electrons for acceleration must be injected from the end opposite from the automodulation end of the accelerator. The high-voltage ring electrode IREB generator 32 is well known in the art and it is believed not necessary to describe it herein.

In operation, an IREB from source 32 having a beam power greater than $10^{10}$ watts is produced and directed into the automodulation region of the accelerator. The automodulation region of the accelerator establishes evenly spaced relativistic electron ring-bunches which function to accelerate injected ions or electrons. The rippled magnetic field along the acceleration region applies a periodically varying magnetic force on the rings of electrons which causes the rings to alternately collapse and expand radially as they pass through the areas of greater and lesser magnetic field strength. Ions injected into either end of the accelerator are attracted by a radially collapsed ring of electrons and accelerated due to the attractive force of the collapsed electron ring. As the ring of electrons expand radially the ions move freely through the expanding ring of electrons toward the next collapsed ring of electrons which attracts and accelerates the ions through the next expanding ring of electrons to the next collapsed ring, etc. Electrons are admitted only into the end of the accelerator opposite from the auto-modulation end and are repelled by a collapsing ring of electrons. As the ring of electrons collapse the admitted electrons are accelerated due to the repulsive force of the collapsing ring of electrons. As the electrons are accelerated by the collapsed ring, the electrons move freely through the next expanded ring of electrons and is again accelerated by the next collapsing and collapsed ring of electrons, etc. The acceleration process is explained below in simple terms.

Figure 2:
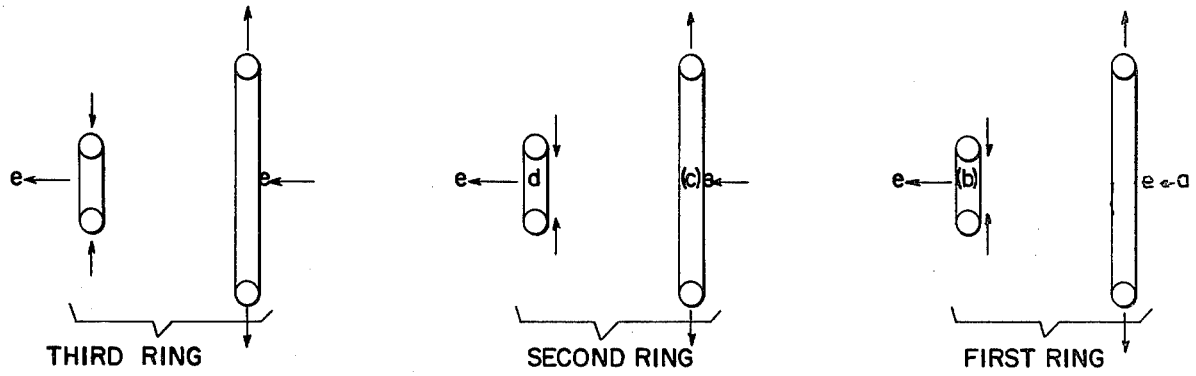
FIG. 2 is a simple illustration of the acceleration of electrons.

A simple explanation for the acceleration is shown and explained by use of FIG. 2. Only three rings of electrons are shown in their expanded and collapsed positions in the rippled magnetic field. The electrons to be accelerated are injected when the "first" ring is expanded at, a (the far right), and as the electron ring collapses to (b), the electron ring repels the electrons to be accelerated. The repulsive force of the electron ring at b accelerates the electrons toward the next ring, C. As the ring C expands the electrons will accelerate beyond the area of electron ring expansion and be repelled by the second electron ring as the electron ring collapses as shown at, d. Thus electrons are accelerated by the collapseing electron rings when the rings are spaced and oscillate with the right phase. Once the electrons reach the automodulation region, the electrons will freely drift through this section and out through the opening in the ring electrode.

Figure 3:
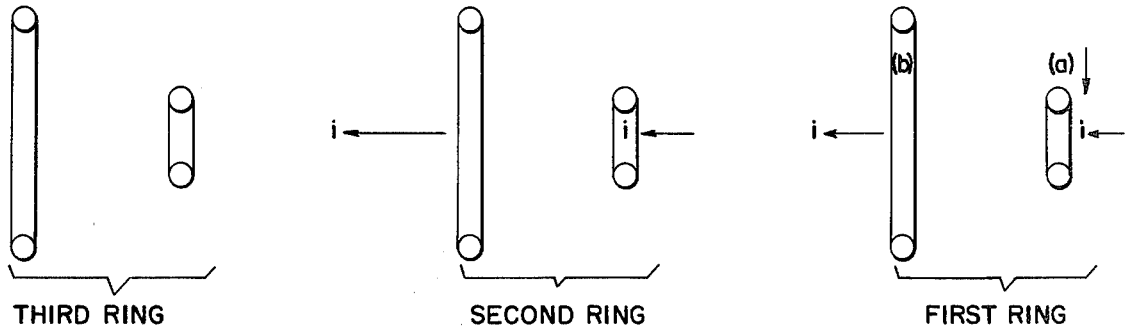
FIG. 3 is a simple illustration of the acceleration of ions.

Ions are accelerated differently as is simply shown by FIG. 3. The ions are accelerated into the injection region at (a), as the electron ring is compressed at (a) and the ions are attracted by the compressed ring of electrons. As the electron ring expands the ions drift thru the drift tube toward the next electron ring, which is compressed to attract the ions, etc., until the ions are accelerated out through the ring cathode.

Ions may be injected into the system through the ring cathode and accelerated in the direction of the flow of the bunched ring electrons by the same method as set forth above. To be accelerated, the injected ions must have a component of axial velocity of the right value. This is discussed later herein.

Another way to look at the acceleration mechanism comes about when one writes the equation of motion of the rings of electrons in the rippled magnetic field. The system looks as if it comprises large amplitude forward and backward "electric waves" with phase velocities which depend on the rippled magnetic field wavelength, 1, and on the modulated electron beam wavelength, λ, see FIG. 4. Ions or electrons with a velocity matching the phase velocity of the wave will be trapped by it and accelerated.

A technical example of the method by which the IREB is bunched is described below. An IREB is generated by the application of a high voltage to the electrode at 32 which emits an annular electron beam with a current of about 10 kA and a voltage of about 500 kV with a 50 nsec duration. The beam radius is about 2 cm and its thickness is about 0.2 cm. A magnetic field of about 10 kG is applied to confine the electron beam in the drift chamber 14. The drift chamber has a length of about 0.6 meters with an inner diameter of about 2.5 cm. The drift tube is evacuated to a pressure of about $10^{-5}$ Torr of air. The automodulation region includes four λ/4 coaxial cavities along its length which causes an automodulation of the electron beam. Each of the λ/4 coaxial cavities are viewed as a parallel "LC" resonance circuit. This resonant circuit is shock energized by a voltage pulse $V_1$ $$V_1 = L dI/dt$$

where L is the inductance associated with each cavity and dI/dt is the rate of change of current flowing at the cavity walls (i.e., the return current). In the above example, $dI/dt = 1.2 \times 10^{12}$ A/sec $L = 10^{-7}$ H; therefore one finds that $V_1 \approx 120$ kV. Each cavity thus will oscillate at a characteristic frequency of 500 MHz with an amplitude of the order of 120 kV. In any two nsec interval, each cavity will first decelerate the beam and absorb energy. Subsequently, in the second nanosecond interval the cavity will give energy to the beam and accelerate the electrons. Since the electrons in the beam are relativistic, a change in their energy will only slightly affect their velocity. This is the reason that all the cavities are energized in the right phase so that the same electrons will always lose energy while the rest of the electrons will always gain energy. The total effect is to extablish rings of relativistic electron bunches embedded in a background of slow electrons. The current modulation is observed because the slower electrons are lost from the beam. The frequency of these bunches will be 500 MHz and the mean particle energy within each bunch is ~1 MeV.

A more complete discussion of the automodulation region has been set forth in *NRL Memorandum Report* 2708 entitled, "Auto-Modulation of an Intense Relativistic Electron Beam", by M. Friedman, January, 1974; and Physics Review Letters No. 32 p. 92, 1974.

The following is a more detailed discussion of the acceleration which is contained in a NRL Memorandum Report 3724, entitled "A New Collective Particle Accelerator", by Moshe Friedman, Feb. 1978.

The axial electric field, on axis, produced by an annular, unneutralized, magnetically focussed IREB propagating through a drift tube of radius R is $$E_z \approx -\left[\frac{1}{2\pi E_o}\frac{\partial Q}{\partial z}\right]\ln\frac{R}{r_b} - \left[\frac{\mu}{2\pi}\frac{\partial I}{\partial t}\right]\ln\frac{R}{r_b} + \frac{Q}{2\pi E_o}\frac{1}{r_b}\frac{\partial r_b}{\partial z} \quad (1)$$

where Q is the charge/length. $Q = I/v$, I is the beam current, $r_b$ is the beam radius and v is the electron velocity. Equation (1) was obtained from Maxwell equations under the assumption that the axial characteristic length is greater than the radius of the drift tube. By covering the drift tube inner wall with a thin dielectric layer of thickness δR and permeability ε one gets from Eq. (1)

$$E_z \approx -\frac{\mu}{2\pi}\frac{1}{\beta^2\gamma^2}\frac{\partial I}{\partial t}\ln\frac{R}{r_b} + \frac{\mu}{2\pi\beta^2}\frac{\epsilon}{\epsilon-1}\frac{\delta R}{R}\frac{\partial R}{\partial t} + \frac{Q}{2\pi\epsilon_o}\frac{1}{r_b}\frac{\partial r_b}{\partial z} \quad (2)$$

by choosing $$\frac{\delta R}{R} \approx \frac{\epsilon}{\epsilon-1}\frac{1}{\gamma^2}\ln\frac{R}{r_b} \quad (3)$$

one gets $$E_z \approx (Q/2\pi\epsilon_0)(1/r_b)(\delta r_b/\delta_z \quad (4)$$

In a case where a modulated IREB is propagating through a rippled magnetic field one inserts in Eq. (4) the following:

$$Q \approx \frac{Q_o}{Z}\left(\sin\left(\frac{2\pi}{\lambda}z - 2\pi ft\right) + 1\right) \quad (5)$$

and $$r_b \approx r_0 + r_1\cos(2\pi z/l); r_1 < r_0 \quad (6)$$

where f and λ are the frequency and wavelength of the modulation, $\lambda f = v$, $r_0$ is the equilibrium radius of the IREB, $r_1$ is the amplitude of the oscillation of the IREB due to the influence or the rippled magnetic field and, l, is the wavelength of the rippled magnetic field. Here we assume that the parallel velocity of the electrons is $v \approx c$.

$$E_z \approx \frac{Q_0}{4\pi\epsilon_0}\left(\frac{r_1}{r_0}\right)\frac{2\pi}{l}\sin\frac{2\pi Z}{l}\left[\sin\left(\frac{2\pi Z}{\lambda} - 2\pi ft\right) + 1\right] \quad (7)$$

rearranging Eq. (7) one gets $$E_z \approx -\tfrac{1}{4}\frac{Q_0}{\epsilon_0}\left(\frac{r_1}{r_0 l}\right)\left\{\cos\left[2\pi Z\left(\frac{1}{\lambda} + \frac{1}{l}\right) - 2\pi ft\right] - \cos\left[2\pi Z\left(\frac{1}{l} - \frac{1}{\lambda}\right) + 2\pi ft\right] + 2\sin\frac{2\pi Z}{l}\right\} \quad (8)$$

Equation (8) describes two "waves" with phase velocities $$(1)\ v_{\phi 1} = v\frac{l}{l+2} \quad \text{forward wave,}$$
$$(2)\ v_{\phi 2} = -K\frac{l}{\lambda - l} \quad \text{backward wave.} \quad (9)$$

Figure 4:
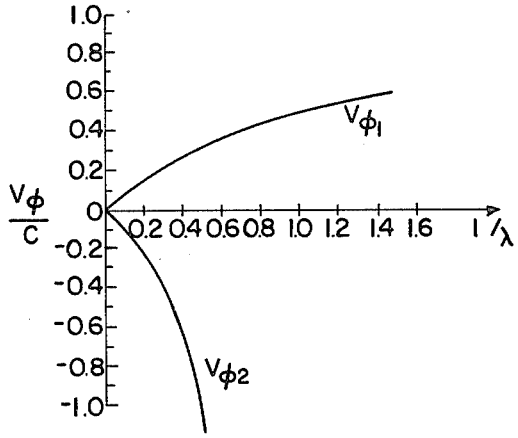
FIG. 4 shows the phase velocities of the forward and backward waves as a function of $1/\lambda$.

FIG. 4 shows the phase velocity of these waves as a function of l. The amplitude of these waves is $$E_{z0} \approx (Q/4\epsilon_0)(r_1/r_0 l) \quad (10)$$

Both waves can accelerate ions but only the backward wave can accelerate electrons since it can have phase velocity approaching c.

The acceleration force acting on particles with velocity v', by this collective mechanism, is impulsive in nature. During a period $$T = [(\lambda \pm l)/2]/v = (l/2)/v'$$

a favorably phased particle will be under the influence of a time-average electric field $2E_{z0}$. For a subsequent period no force will act on the particle. Formally, this mechanism resembles a nonlinear Landua damping process in which a fictitious wave (the rippled magnetic field) the wavelength, l, and zero frequency combine with a beam wave of wavelength λ and frequency f to exert a force on a particle and accelerate it.

If electrons are to be accelerated by this mechanism the backward wave has to be used. By choosing $\lambda \approx 2l$, the phase velocity of the backward wave is c. An IREB of 80 kA current and particle energy of 3 MeV can easily be modulated with a 1 GHz frequency. The automodulation technique which is used to modulate the IREB can also increase the particle energy within the beam to $V \approx 5$ MeV. Passing this beam through a rippled magnetic field with $l = 15$ cm and $r_1/r_0 \approx 0.30$, one gets $E_{z0} \approx 15$ MV/meter.

The electron accelerator can work in two modes. In the first mode the duration of the accelerated electrons is about the duration of the IREB. In that case the accelerated current $I_1$ and the final energy of the accelerated electrons $E_f$ have to satisfy the relation $$I_1 E_f \leqq IV. \quad (11)$$

Here, each bunch loses energy continuously along the acceleration length.

In the second mode of operation, the duration of $I_1$ is smaller than (l/2)/c. Only during this duration each bunch loses energy. In that case $$I_1 E_f \leqq IV(S/l) \quad (12)$$

where S is the total length of the accelerator, $S >> l$ and $S \lesssim c\tau/2$ and $\tau$ is the duration of the IREB. From Eqs. (10) and (12) one gets $$I_1 \lesssim 4\epsilon_0 Vc(r_0/r_1). \quad (13)$$

In practice $I_1$ may have to be smaller so as to reduce effects of two stream instability. It seems that if $I_1 \approx 0.1$ I the growth rate of the instability will be small especially for high λ.

The final energy of the accelerated electrons will be $$E_f = (E_z L)(S/l);\ S = c\tau/2 \quad (14)$$

for $\tau = 100$ ns and for the same IREB parameters mentioned earlier one gets $E_f \approx 200$ MeV, $S = 15$ meters and $I_1 = 8$ kA.

The same mechanism that accelerates electrons can accelerate ions. Here, too, the backward wave can be used for acceleration. (One can also use the forward wave for one acceleration.) In addition to the acceleration force there is a radial force, generated by the IREB, focusing the ions. A simple way for looking at the focusing force is to consider the case of solid ion beam flowing within an annular IREB. Here two forces will act on an ion. The first force results from the self electric field of the ion beam. This electric field will accelerate an ion to a outward radial velocity at the radius of the IREB.

$$v_{ri} \approx \sqrt{\tfrac{1}{2}(ZeQ_i/2\pi\epsilon_0 m)} \quad (15)$$

where $Q_i$ is the charge/length of the ion beam, Z is the effective charge of the ion, and M its mass. A second force acts on the ions when they enter the trajectories of the electrons. This force will give an ion an inward radial valocity of $$v_{ri} \approx \sqrt{(ZeQ/2\pi\epsilon_0 m)(\delta a/a)} \quad (16)$$

where δa is the thickness of the IREB. From Eq. (15) and (16) we can see that the ion current that can be radially confined inside an IREB is $$I_{ion} \approx 2(\delta a/a)(vi/v)I. \quad (17)$$

If one takes I=80 kA, $v_i/v \approx 0.06$, Z=1, δa/a26 0.1 we get that $I_{ion} \approx 10^3$ amps can be focused. Similar calculation shows that 100 amps of $U^{+10}$ can be focused when the initial velocity of the ions is $v_i=0.006$ c.

The mechanism for ion acceleration is similar to the electron acceleration discussed earlier. At the axial position where the ions start the acceleration l and λ are chosen such that $$V_{\phi 2} = -V\frac{l}{\lambda - l} = Vi(<<c).$$

For the case of Z=1, $v_i=0.06$ c one choses l=10 cm, and λ=170 cm. For I=80 kA and $r_1/r_0 \approx 0.067$ the accelerating electric field $E_z \approx 5$ MV/m. In order to maintain the force and the ion in phase, l has to be changed. While the ion is accelerating l is changing such that $v_{\phi 2}=v_i$. At the same $(r_1/r_0)$ l is being kept constant such that $E_z \approx 5$ MV/m. This easily can be done for any l up to l=45 cm. When l=45 cm, one gets $r_1/r_0 \approx 0.3$ and $v_{\phi 2} \approx 0.36$ c corresponding to energy of 67 MeV. Since values of $r_1/r_0$ greater than 0.3 may not be technically possible one has to increase l without increasing $(r_1/r_0)$. In that case Ez will drop when l increases beyond 45 cm and the acceleration length will become very long. In order to avoid a long accelerator and be able to get energies greater than 67 MeV the ion beam has to be injected into a second generator. At the injection point l=10 cm, λ=38 cm and $r_1/r_0 \approx 0.15$ such that $E_z \approx 11.2$ MV/m, and $v_{\phi 2}=0.36$ c. Changing l from 10 cm to 19 cm, $v_{\phi 2}$ increases to c. Simultaneously $r_1/r_0$ is being changed to 0.3 so that $E_z$ stays constant and is equal to 11.2 MV/m. Only 100 meters of acceleration length are needed to obtain particle energy of 1 GeV.

A similar consideration can show that for a beam of $U^{+10}$ ions to reach energy of 1 GeV it is necessary to have an acceleration length of 44 meters.

For the acceleration mechanisms to work, ions with the right velocity have to be injected into the IREB. The injection mechanism is part of the acceleration mechanism. The modulated IREB is terminated on a metal plate or foil. The place of termination is the equator of one of the mirror magnetic fields. Ions will accelerate between the metal plate and the apex of the mirror magnetic field and reach a velocity $$V_i \approx (Ze/m)(Q/\epsilon_0)(r_1/r_0 l)(\lambda/c). \quad (18)$$

It is easy to show that with the IREB parameters discussed earlier one can get $V_i \approx 0.06$ c for Z=1.

One of the important parameters in the above mechanism is the strength of the external magnetic field. It has been found that an IREB propagating through a rippled magnetic field produces microwave radiation and its characteristics are drastically modified. It has been likewise found that a critical magnetic field exist above which very little microwave power is produced and the beam characteristics do not change.

$$B_c \approx (2\pi/l)(mc/e)\gamma. \quad (19)$$

For l=15 cm, λ=10, one gets $B_c \approx 7$ kG.

In the mechanism discussed the electron beam is propagating in a smooth metallic drift tube. The beam can interact only with fast rf waves. The interaction is very weak and under certain conditions very little microwave radiation is produced and no beam deterioration has been observed.

Obviously many modifications and variations of the present invention are possible in light of the above teachings. It is therefore to be understood that within the scope of the appended claims the invention may be practiced otherwise than as specifically described.

What is claimed and desired to be secured by Letters Patent of the United States is:

1. A method of accelerating charged particles by means of an IREB comprising the steps of:

propagating an annular IREB within a longitudinal drift tube and density modulating said beam to obtain a plurality of longitudinally spaced ring-shaped bunches of electrons;

forming a rippled magnetic field with a desired wavelength within said tube;

passing said modulated beam through said rippled magnetic field to alternately compress and expand said rings of electron bunches in the radial direction;

generating forward and backward electric field waves within said beam; and injecting charged particles into said beam, said charged particles having a component of velocity in the longitudinal direction for capture and acceleration of said charged particles by said beam.

2. A method as claimed in claim 1 wherein:

said charged particles are ions.

3. A method as claimed in claim 1 wherein:

said charged particles are electrons.

4. A method as claimed in claim 2 wherein:

said ions to be accelerated may be injected into either end of said longitudinal drift tube.

5. A method as claimed in claim 1 which includes forming said rippled magnetic field by placing axially-disposed magnetic-field-producing means coaxially with said longitudinal drift tube.

6. A method as claimed in claim 1 which includes:

forming the rippled magnetic field wavelength and the modulated electron beam wavelength to produce the space-charge waves with desired phase velocity, and injecting said charged particles into said beam such that the phase velocity of the injected charged particles matches the phase velocity of the beam wave during the acceleration phase.

7. A particle accelerator which comprises:

longitudinal drift tube means having a uniform inner diameter;

means for generating an annular IREB and injecting said annular beam into said longitudinal drift tube;

means for modulating said beam to obtain bunches of longitudinally spaced rings of electrons;

means for forming a longitudinal, rippled magnetic field in axial alignment with said means for modulating said beam and coaxial with said drift tube;

means for generating forward and backward electric field waves within said beam; and means for injecting charged particles into said beam, said charged particles having a component of velocity in the longitudinal direction for capture and acceleration of said charged particles by said beam.

8. A particle accelerator as claimed in claim 7 wherein:

said means for forming said rippled magnetic field includes means for forming a uniform, homogeneous magnetic field surrounding said drift tube, and magnetic-field-forming means confined by said homogeneous magnetic-field-producing means to vary the homogeneous magnetic field to form alternate sections of greater and lesser magnetic field strength.

9. A particle accelerator as claimed in claim 7 wherein:

said forward and backward electric field waves have a phase velocity which depends upon the rippled magnetic-field wavelength and on the modulated electron beam wavelength, and the phase velocity of the injected charge particles matches the phase velocity of the beam wave during the acceleration phase.

10. A particle accelerator as claimed in claim 8 wherein:

said homogeneous magnetic-field-producing means includes a plurality of side-by-side coils.

* * * * *